US005567084A

United States Patent [19]

Oliver

[11] Patent Number: 5,567,084

[45] Date of Patent: Oct. 22, 1996

[54] BUOYANCY COMPENSATOR WITH A TRACTION PRESSURE PAD

[75] Inventor: Bill N. Oliver, Dana Point, Calif.

[73] Assignee: Sea Quest, Inc., Carlsbad, Calif.

[21] Appl. No.: 394,361

[22] Filed: Feb. 24, 1995

[51] Int. Cl.[6] ..... A45F 3/08

[52] U.S. Cl. ..... 405/186; 256/32; 441/114

[58] Field of Search ..... 405/186; 441/114, 441/115, 116; 224/210, 211, 907

[56] References Cited

U.S. PATENT DOCUMENTS 4,690,314 9/1987 Faulconer et al. ..... 224/211

5,522,679 6/1996 Eungard ..... 405/186

*Primary Examiner*—Henry A. Bennett
*Assistant Examiner*—Pamela A. O'Connor
*Attorney, Agent, or Firm*—George F. Bethel; Patience K. Bethel

[57] ABSTRACT

The invention provides a novel backpack for use with a vest and buoyancy compensator combination. The backpack has a recess in which is disposed a novel traction pad. The traction pad is formed of a thin pad of resilient material capable of compression when a breathing gas tank is tightly held against it by means of a strap and fastener. This active compression holds the breathing gas tank in place.

20 Claims, 2 Drawing Sheets

BUOYANCY COMPENSATOR WITH A TRACTION PRESSURE PAD

FIELD OF THE INVENTION

This invention relates to the field of buoyancy compensators and particularly to a combination buoyancy compensator, backpack and spider having a traction pressure pad for a pressurized breathing gas tank that facilitates the use thereof.

DESCRIPTION OF THE PRIOR ART

Underwater diving preferentially requires the use of a buoyancy compensator having an inflatable bladder to provide for buoyancy trim or compensation to a diver.

Buoyancy compensators are inflated by oral power or compressed gas inflation means. During inflation, the diver is provided with increased buoyancy at greater depths to overcome the fact that a diver's buoyancy decreases as he dives deeper. This is because with greater pressure, a loss takes place regarding the lifting characteristics of the diver's buoyancy, due in part to compression of his exposure suit and associated diving equipment.

Conversely, as the diver ascends or approaches the surface his buoyancy increases as the compression of his exposure suit and other equipment recovers. As inherent buoyancy is regained, air must be released from the buoyancy compensator to return the system to neutral buoyancy.

Thus, by increasing or decreasing the buoyancy provided by the buoyancy compensator, a diver can adjust his buoyancy to a neutral state. This is provided by either adding air to the buoyancy compensator or releasing it.

In recent years, buoyancy compensators have been combined with a vest configuration commonly called a spider with means to hold a diver's backpack that supports a cylinder or tank of pressurized breathing gas on a diver's back. The combination of the backpack with the buoyancy compensator serves to distribute the weight of the breathing gas tank over the shoulders and back of a diver.

As used herein and in the appended claims, the term "combination buoyancy compensator" is meant to describe the combination of a vest or spider, buoyancy compensator, and backpack.

The vest configuration often includes shoulder straps and a front closing waist or belt fastener for ease in putting on and securing the combination buoyancy compensator.

The diver's backpack is commonly formed of a plastic insert having a generally inverted T-shape. The upright portion of the T is provided with one or more pairs of slots. Each pair of slots receives a band or strap which can circumscribe or surround a breathing gas tank to hold it tightly against the backpack.

Generally, the strap is a relatively inelastic material such as nylon webbing. A tensioning device such as a cam type overcenter latch provides a means to secure the upright breathing gas tank to the upright backpack by means of frictional engagement.

A metal band such as a stainless steel band having an overcenter latch or other tightening means can be used in place of the strap to secure the upright breathing gas tank in frictional engagement with the upright portion of the backpack.

The upright portion can be provided with longitudinal support ribs to provide strength to the upright portion and to allow drainage of water. The ribs can be configured to define a curved surface contoured to snugly fit the curved dimensions of a pressurized breathing gas cylinder placed against it. A backpack of this description is shown in U.S. Pat. No. 4,690,314.

When a breathing gas tank or cylinder is tightly secured to a backpack, the weight of the breathing gas tank causes a downward pressure or force. In order to avoid slippage of the breathing gas tank downwardly relative to the upright portion, the bands or straps must be securely fastened.

The clamping force required to prevent slippage is dependent on the frictional properties of the tank and backpack surfaces and is proportional to the tension applied to the bands. Since the band or strap is inelastic, there is a small range of adjustment to the band length that will allow both a reasonable closing force for the tensioning device or overcenter latch and an adequate clamping force between the breathing gas tank and the backpack.

Adjusting the band can require a tedious series of adjustments before the correct tension is reached. In addition, small changes in the band or strap length caused by the stretching of the strap material can result in significant relaxation of band tension and clamping force which requires further adjustment. Exposure to water often causes the straps to stretch requiring adjustment.

Since the strap or band holding the breathing gas tank is impossible to reach while wearing the combination buoyancy compensator, any adjustments must be made by removing the combination buoyancy compensator. This can be quite inconvenient, particularly if several adjustments are required.

It is an object of the invention to provide a combination buoyancy compensator which more efficiently secures the breathing gas tank to the backpack.

It is a further object of the invention to provide a combination buoyancy compensator having a backpack which can secure a breathing gas tank with greater ease of adjustment and with greater security than with conventional buoyancy compensators.

SUMMARY OF THE INVENTION

The invention provides a novel backpack having a novel traction pad disposed in a recess for use with a spider or vest and buoyancy compensator. The traction pad is formed of a relatively thin pad of resilient material capable of compression. The pad is placed in a recess within the backpack and preferably has a thickness which is slightly greater than the depth of the recess.

A breathing gas tank or cylinder is placed into surface contact with the traction pad. A strap or band is interlaced through slots within the backpack and surrounds the breathing gas tank. A tensioning device such as an overcenter latch or other fastener unites the ends of the strap and tightly presses or clamps the breathing gas tank against the traction pad.

When the strap is tightened and the overcenter latch is applying pressure, the force against the breathing gas tank initially compresses the resilient material. When the tensioning device or overcenter latch passes overcenter and is secured, the band or strap necessarily is lengthened a small amount and the resilient material expands to maintain a reaction force against the breathing gas tank and backpack. The reaction force combined with the frictional properties of the resilient material prevents slippage between the breathing gas tank and the backpack.

When the overcenter fastener is opened, the compressive force is released and the resilient material springs back to its former thickness.

In a preferred embodiment, the traction pad is provided with areas having raised ribs which deform first under pressure to enhance the gripping action of the pad in contact with the surface of the breathing gas tank.

The backpack has a generally elongated upright portion which has a curve on one side corresponding to the curved surface of a breathing gas tank. The opposite side of the upright portion is preferably provided with a reinforcing framework or skeleton giving strength without weight. Preferably, the framework is heavier and thicker at the base of the upright portion than at the top to accommodate the inward waist curve of the backbone of a diver and to increase comfort. The backpack is preferably molded from a relatively hard plastic.

A central area of the curved surface is provided with a hollow or recess for receipt of the traction pad. Means in the form of slots are provided within the upright section for receipt of a band or strap to surround and tightly hold a breathing gas tank in contact with the traction pad.

The backpack includes means in the form of flanges extending from the upright portion for securing the backpack within the spider or vest of a buoyancy compensator.

BRIEF DESCRIPTION OF THE DRAWINGS

The invention will be more clearly understood by referring to the description below and the accompanying drawings in which.

DETAILED DESCRIPTION OF THE INVENTION

Figure 1:
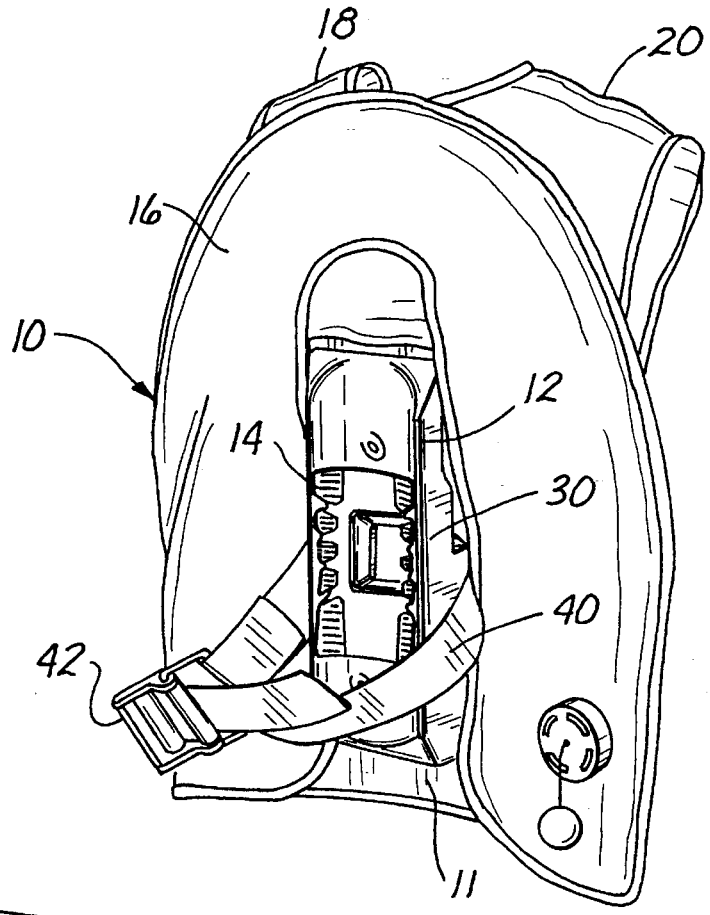
FIG. 1 shows a perspective view of the combination buoyancy compensator incorporating the novel backpack of time invention.

Referring now to FIG. 1, there can be seen a perspective rear view of a buoyancy compensator 10, and a vest 11 with a backpack 12 having a pressure traction pad 14 according to the invention.

The vest 11 includes shoulder portions 18 and 20 which are only partially shown which help to distribute the weight of a breathing gas tank, not shown. The buoyancy compensator 10 includes an inflatable inverted U-shaped portion 16 which surrounds the backpack 12 and is attached to the back of the vest 11.

Figure 2:
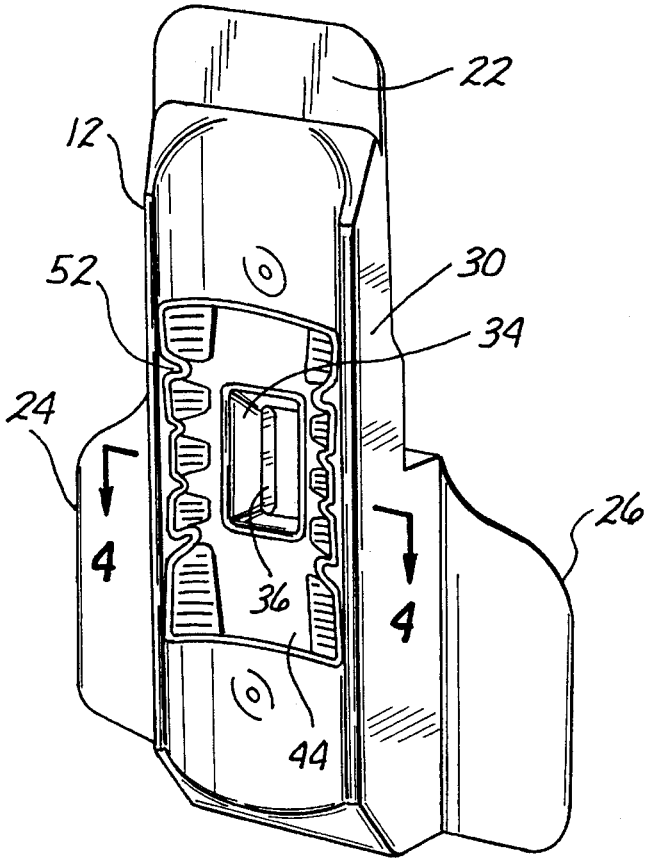
FIG. 2 shows a perspective view of the novel backpack of the invention.

As can be seen in FIG. 2, the backpack 12 has a generally inverted T-shape which includes a top flange 22 which is preferably stitched or otherwise attached to the vest 11. Similarly, side flanges or wings 24 and 26 of backpack 12 are also preferably stitched or attached in some other manner to the vest 11.

Figure 3:
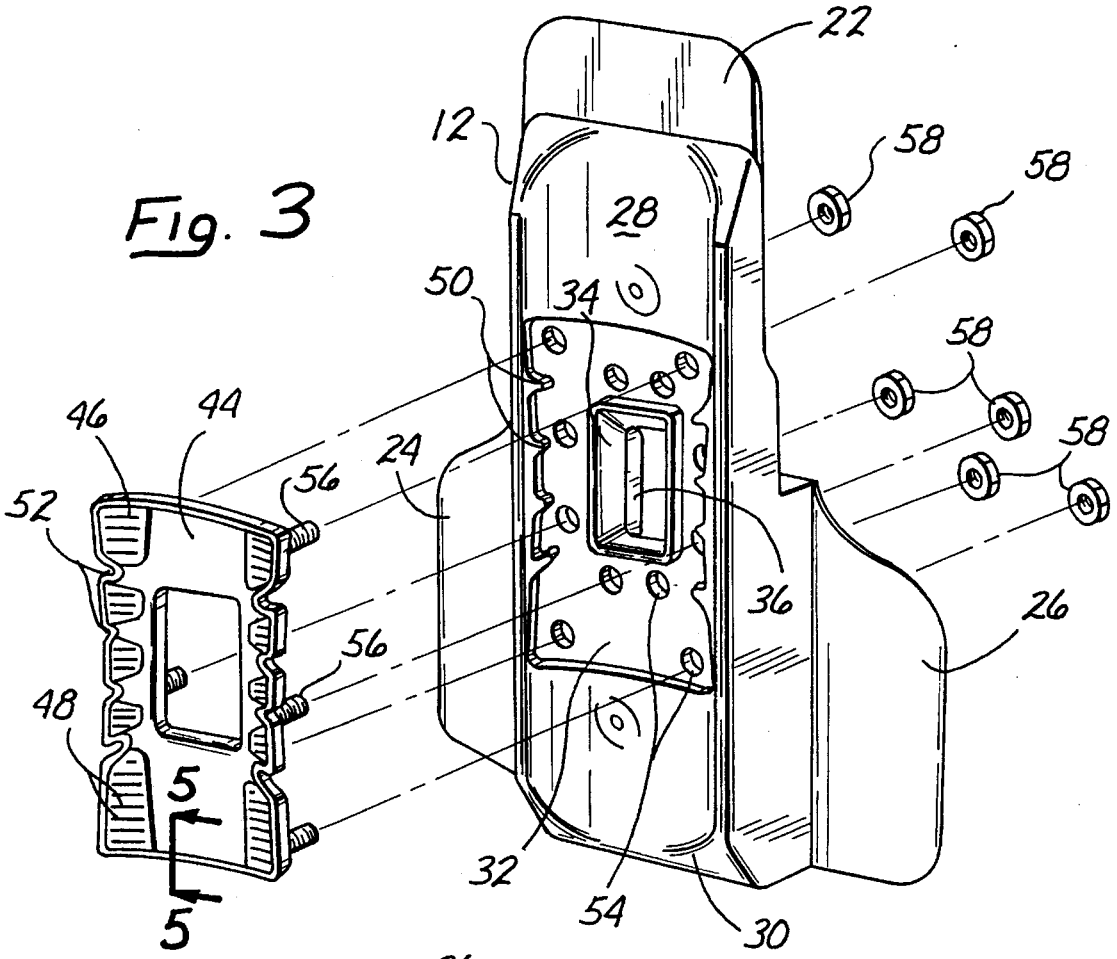
FIG. 3 shows an exploded perspective view of the backpack of the invention with the traction pad separated from the body of the backpack.

As detailed in FIGS. 1–3, the backpack 12 has a generally inverted T-shape having a narrow rectangular upright member 30. Upright member 30 has a concave exterior surface 28 adapted to receive the curved exterior surface of a breathing gas tank.

As shown in FIG. 3, a depression or recess 32 is integrally formed within the curved surface 28 of the backpack 12 and positioned approximately midway between the top and bottom of the curved surface 28.

The recess 32 has a depth of approximately ¼ inch below and follows the curve of the surface 28. Within the recess 32 is a deeper, smaller indentation or depression 34 having a substantially rectangular configuration. At the base of the indentation 34 is a pair of slots 36 and 38 which receive a strap or band 40 for surrounding a breathing gas tank, not shown. The ends of the strap or band 40 are secured with an overcenter latch 42 or other fastener means such as a buckle.

Surrounding the indentation 34 and disposed within the recess 32 is a thin, resilient pad 44 which is slightly thicker than the depth of recess 32. The face of the resilient pad 44 has a plurality of slightly raised areas 46 which have ribs 48 to more effectively grip the surface of a breathing gas tank surface.

Preferably, the raised areas 46 are disposed along the longitudinal edge regions of the resilient pad 44.

Figure 4:
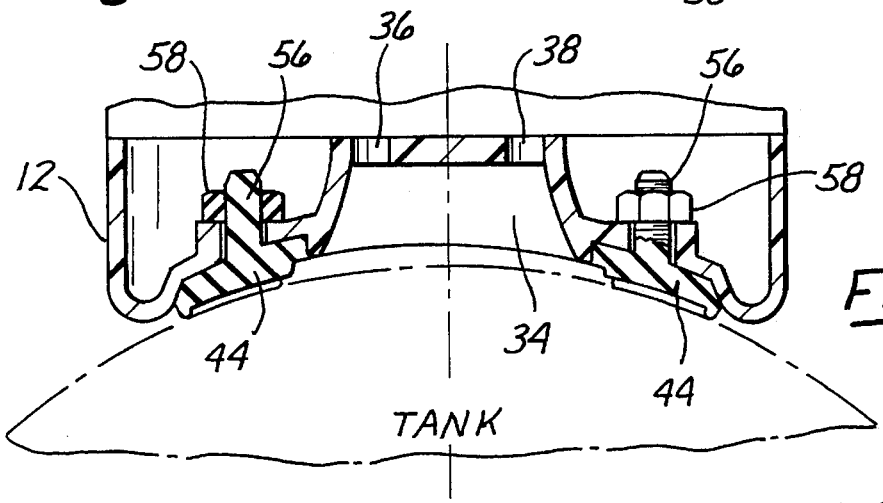
FIG. 4 shows a cross section taken along the lines 4—4 of FIG. 2.
Figure 5:
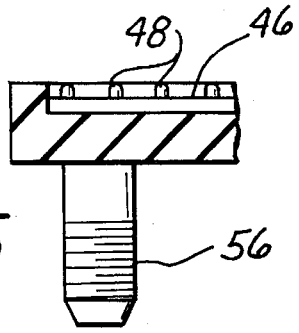
FIG. 5 shows a cross section taken along the lines 5—5 of FIG. 3.

The resilient pad 44 is secured within the recess 32 by means of a plurality of exteriorly threaded shanks or studs 56 which are received within a plurality of openings 54 within the base of recess 32. The threaded shanks or studs 56 are secured within the openings 54 by means of nuts 58 as shown in FIG. 4. In this manner, the resilient pad 44 is held firmly within the recess 32.

Other securement means can be substituted for the threaded shanks or studs 56. Also, the resilient pad 44 can be attached using a surface adhesive either alone or in conjunction with the shanks or studs 56. It can also be molded with tabs into the side walls of the backpack or frictionally engaged with engaging extensions.

In order to further provide resistance against slippage of a breathing gas tank, the peripheral longitudinal edge of the recess 32 is preferably crenelated or toothed as indicated at 50. The resilient pad 44 has grooves 52 which receive the toothed edge 50. Here again, tabs or protuberances of the pad 44 can be used to engage an undercut or opening of the backpack recess 32.

One function of the toothed edge 50 of the recess 32 and the grooves or channels 52 of resilient pad 44 is to interlock the pad 44 against downward movement. In effect, the toothed edge 50 locks the pad 44 in place.

The backpack 12 is preferably formed of a high density polyethylene although other polymers can be used.

The resilient pad 44 can be made of any polymer material which provides sufficient resiliency at a given thickness and surface area in contact with a breathing gas tank to prevent slippage. Excellent results have been obtained using a polymer having a Shore A hardness in the range of 55–80. Examples of such polymers includes among others PVC (polyvinylchloride), polyurethane, and Santoprene™.

Preferably the resilient pad 44 has a thickness of about ¼ inch when using a polymer having a Shore A hardness in the range of 55–80. The resilient pad 44 acts as a spring, compressing upon forceful contact with the surface of the breathing gas tank and then providing a counterforce or spring action when the pressure is slightly released.

The optimum thickness for a particular material can be determined empirically. Preferably, the resilient pad 44 extends slightly above the peripheral edge of the recess 32. When under compression, the resilient pad 44 preferably forms a continuous surface with the adjacent surrounding surfaces of the backpack 12.

A particular advantage of the invention is that the backpack 12 and resilient pad 44 increase the friction between the surface of the pad 44 and the surface of a breathing gas tank strapped against the pad 44. This provides greater ease of adjustment with greater security.

At the same time, the springlike nature of the resilient pad reduces the peak force needed to strap or secure the breathing gas tank onto the backpack. This feature is advantageous for all divers, but particularly for women and children.

Many of the straps used to secure a breathing gas tank to a backpack are made of nylon which, when exposed to water, can stretch. Thus, a breathing gas tank secured with dry straps can loosen requiring resecuring. By using the backpack and resilient pad of the invention, sufficient traction or slip resistance is provided so that the band can be secured even if dry.

Various modifications of the invention are contemplated which will be obvious to those skilled in the art and can be resorted to without departing from the spirit and scope of the invention as defined by the following claims.

I claim:

1. A backpack means for supporting a breathing gas tank comprising:

an elongated upright support member;

a recess disposed within said support member;

a resilient pad disposed within said recess for surface contact with said breathing gas tank; and, means for securing said breathing gas tank in surface contact with said resilient pad.

2. A backpack means according to claim 1 further comprising:

a curved surface on said support member which substantially corresponds to the curved surface of said breathing gas tank to be supported; and wherein, said recess is disposed within said curved surface of said support member.

3. A backpack means according to claim 2 wherein:

said recess is of substantially uniform depth and has a base which substantially follows the curve of said support member; and, said resilient pad has a thickness slightly greater than the depth of said recess.

4. A backpack means according to claim 3 wherein:

said resilient pad when disposed within said recess substantially forms a continuation of said curve of said support member.

5. A backpack means according to claim 4 further comprising:

said recess having a generally elongated rectangular shape having elongated parallel sides, and, said elongated sides having crenelations;

said resilient pad being formed to fill the recess including said crenelations.

6. A backpack means according to claim 5 further comprising:

a plurality of ribbed areas disposed on the exterior surface of said resilient pad.

7. A backpack means according to claim 6 further comprising:

means for attaching said resilient pad within said recess; and, said elongated upright support member having a top portion and a bottom portion, said bottom portion being substantially thicker than said top portion and wherein said bottom portion has a concave curve corresponding generally to a curve of a diver's back.

8. A backpack means according to claim 7 wherein said means for attaching said resilient pad comprises:

openings within said recess;

shank members attached to said resilient pad which are received within said recess openings; and, means for securing said shank members within said openings.

9. A backpack means according to claim 8 wherein said shank members are exteriorly threaded and wherein nuts are threaded over said shank members to secure said shank members within said openings.

10. A backpack means according to claim 1 wherein said resilient pad is characterized by an elastic memory whereby it can compress upon surface contact with said breathing gas tank and then exert counterpressure by virtue of its resiliency.

11. A backpack means according to claim 7 further comprising:

a depression within said recess; and, slots within said depression for receiving strap members for securing the surface of said breathing gas tank against said resilient pad.

12. The combination of a buoyancy compensator, vest and backpack means comprising:

a vest having a back, shoulder portions, and front portions;

means for securing said front portions together;

a backpack means secured to said vest back for supporting a breathing gas tank;

a buoyancy compensator secured to said vest;

said backpack means comprising;

an elongated upright support member;

a recess disposed within said support member;

a resilient pad disposed within said recess for surface contact with said breathing gas tank; and, means for securing a breathing gas tank in surface contact with said resilient pad.

13. A combination vest, buoyancy compensator and backpack according to claim 12 further comprising:

a curved surface on said support member which substantially corresponds to the curved surface of a breathing gas tank to be supported;

said recess is disposed within said curved surface of said support member; and, said recess has a base which substantially follows the curve of said support member.

14. A combination vest, buoyancy compensator and backpack means according to claim 13 wherein:

said resilient pad when disposed within said recess substantially forms a continuation of said curve of said support member; and, wherein said resilient pad is characterized by an elastic memory whereby it can compress upon surface contact with said breathing gas tank and then exert counterpressure by virtue of its resiliency.

15. A combination vest, buoyancy compensator and backpack means according to claim 14 wherein said means to secure said straps around said breathing gas tank comprises:

an overcenter latch.

16. A backpack means for a breathing gas tank comprising:

an elongated upright member having a major surface with a curve corresponding to the curve of said breathing gas tank to be supported;

a shallow recess disposed within and following said curve;

said backpack means having means for receiving straps therein for securing said breathing gas tank against said curved surface;

a resilient pad secured within and conforming to the dimensions of said shallow recess; and, means attached to said backpack means for removably securing said backpack means against a diver's back.

17. A backpack means for said breathing gas tank according to claim 16 wherein said resilient pad has a Shore A hardness in the range of about 55 to 80.

18. A backpack for said breathing gas tank according to claim 17 wherein said recess surrounds said depression and has a substantially uniform depth of about ¼ inch.

19. A backpack means for said breathing gas tank according to claim 18 wherein said resilient pad is slightly thicker than the depth of said recess.

20. A backpack means for said breathing gas tank according to claim 19 further comprising:

openings within said recess;

exteriorly threaded shank members attached to said resilient pad which are received within said recess openings; and, nuts which are threaded over said shank members to secure said shank members within said openings.

* * * * *